United States Patent [19]

Gruner et al.

[11] 4,100,959

[45] Jul. 18, 1978

[54] TREATING A STREAM OF MOLTEN METAL

[75] Inventors: Hans Gruner; Hans Schrewe, both of Duisburg; Gerd Diederich, Angermund; Claus-Dieter Haufe, Duisburg; Fritz-Peter Pleschiutschnigg, Angermund, all of Fed. Rep. of Germany

[73] Assignee: Mannesmann Aktiengesellschaft, Dusseldorf, Fed. Rep. of Germany

[21] Appl. No.: 770,449

[22] Filed: Feb. 22, 1977

[30] Foreign Application Priority Data

Feb. 23, 1976 [DE] Fed. Rep. of Germany ..... 2607735

[51] Int. Cl.[2] ..... B22D 11/10

[52] U.S. Cl. ..... 164/56; 164/154; 75/58; 75/59

[58] Field of Search ..... 164/56, 4, 417, 154, 164/418; 75/58, 59; 425/6

[56] References Cited

U.S. PATENT DOCUMENTS

| | | | |
|---|---|---|---|
| 2,997,386 | 8/1961 | Ferchtinger | 75/59 X |
| 3,295,960 | 1/1967 | Parlee et al. | 75/78 X |

FOREIGN PATENT DOCUMENTS

| | | | |
|---|---|---|---|
| 1,249,854 | 10/1971 | United Kingdom | 164/56 |

*Primary Examiner*—Robert L. Spicer, Jr.
*Attorney, Agent, or Firm*—Ralf H. Siegemund

[57] ABSTRACT

Molten steel pouring from a ladle into a tundish is surrounded by a vessel which is pressurized to maintain an excess pressure of an inert gas and/or a gas or vapor of a material that treats the steel, e.g., for deoxidizing, desulfurizing and/or other cleansing action. The excess pressure per se inhibits any reoxidation. Reactant material is fed to the chamber at a rate to maintain the excess pressure and/or to ensure sufficient presence of reacting material commensurate with the amount of steel passing through.

13 Claims, 3 Drawing Figures

TREATING A STREAM OF MOLTEN METAL

BACKGROUND OF THE INVENTION

The present invention relates to preventing re-oxidation of metal during casting. More broadly, the invention relates to chemical treatment and/or inhibition of undesired reactions of molten metal particularly during continuous casting.

The German printed patent application No. 2,029,913 discloses a method of accelerated mixing of different phases and/or for accelerating chemical reaction or physical phenomena. In furtherance thereof, this publication discloses that metal be poured into a chamber being open at the bottom. That chamber is dimensioned in relation to inlet and outlet passages for the molten metal so that the kinetic energy of the flowing material creates a reduced pressure in the chamber, i.e., a local pressure below the normal static pressure. As a consequence, air is sucked continuously into the chamber and the oxygen thereof reoxidizes the previously purified metal.

It is also known to feed pouring metal into an intermediate vessel under positive exclusion of air (see for example German printed patent application No. 2,119,664, or French Pat. No. 2,026,294). Aside from the inherent difficulties posed here, it was found that reoxidation is not adequately prevented in that manner.

DESCRIPTION OF THE INVENTION

It is an object of the present invention to avoid reoxidation of molten metal as it is being poured during casting under conditions which permit additionally chemical treatment of the metal.

In accordance with the preferred embodiment of the present invention, it is suggested to envelope the pouring metal by means of a vessel of sufficient dimensions so that an excess pressure, above atmospheric pressure, can be and is maintained. The pressure is generated, for example, by an inert gas which is being continously replenished, whereby additional particular gas compounds may be added for chemical treatment of the metal, e.g., cleaning it. In addition, or in lieu thereof, solids are fed to that chamber which evaproate and provide also such treatment under excess pressure conditions. Generally speaking, the excess pressure may be exclusively provided by the treatment materials which, in the gaseous phase maintain that excess pressure. The pressure in that chamber may be continuously measured and used as indication and control for adding additional substance of the reactants.

By way of example, metallic calcium and/or magnesium may be fed to such a chamber which is being passed through by a stream of molten steel, pouring from a ladle into a tundish, or from the tundish into the mold. These metals provide for deoxidation and desulfurization of the steel. The metal vapor pressure may well suffice as excess pressure to keep any oxygen out of the chamber, and to prevent, in addition, reoxidation of the steel on its way from one vessel to the other.

Just introducing nitrogen was found to be sufficient to avoid reoxidation if, for example, an excess pressure from 300 to 400 m water is maintained. The nitrogen to which, e.g. argon, may be added, provides some cleaning of the metal, e.g., steel.

In any event, the excess pressure in the chamber inhibits reoxidation and the, or a substance, generating or participating in the formation of the excesspressure provides additional chemical treatment.

DESCRIPTION OF THE DRAWINGS

While the specification concludes with claims particularly pointing out and distinctly claiming the subject matter which is regarded as the invention, it is believed that the invention, the objects and features of the invention and further objects, features and advantages thereof will be better understood from the following description taken in connection with the accompanying drawings in which:

Figure 1:
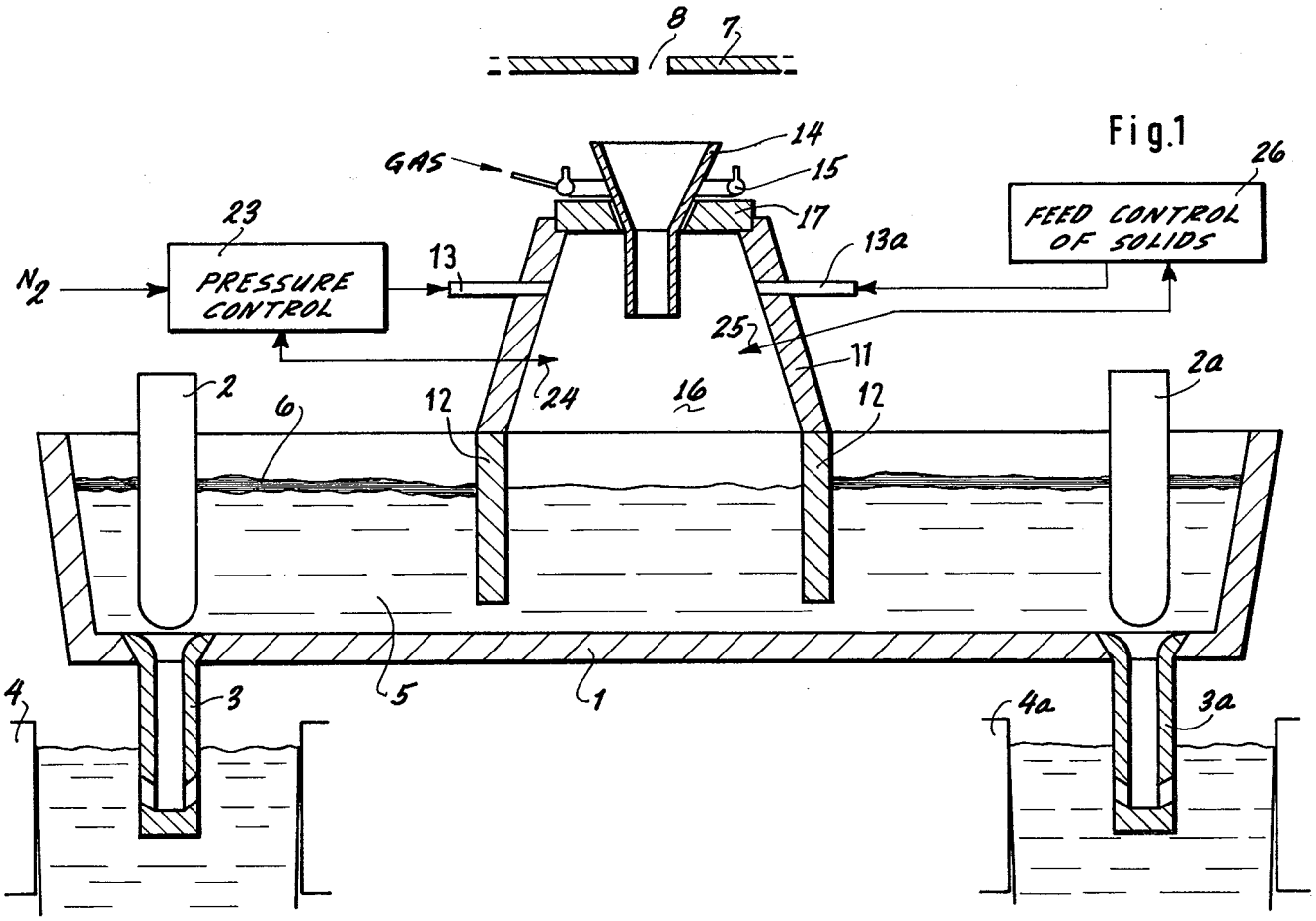
FIG. 1 is a cross-sectional view through equipment for practicing the preferred embodiment of the invention.

Proceeding now to the detailed description of the drawings, the FIG. 1 shows a tundish 1 receiving a stream of molten metal, e.g., steel 5 fram ladle 7, and holding the molten steel 5 at a particular level. A slag layer 6 is formed and accumulated on the surface of the pool of steel.

The tundish 1 has two outlets controlled by stoppers 2, 2*a*. Those outlets lead to feed pipes 3, 3*a* which are closed at the bottom and have upwardly slanted exit nozzles. These nozzles are submerged in molten steel in two molds 4, 4*a* for continuous casting. The molds are of conventional construction; there may be additional molds in the machine.

The tundish 1 is additionally provided with slag barriers or baffles 12 to separate a slag free zone for steel in tundish 1 from the temainer of the steel. The slag free zone results from the fact that the steel surface in that zone is not in contact with the outer atmosphere, instead, a vessel 11 sits on these barriers 12, thereby defining a reaction chamber 16 above that particular portion of the steel that will remain slag free.

It can thus be seen that in a general sense a three vessel arrangement is provided, whereby from a first vessel, the ladle, steel is poured into a second vessel, the tundish, and the stream passes through a third vessel, vessel 11, surrounding the stream and separating it from the environment.

The vessel 11 is provided with a plurality of feed ducts 13, 13*a* for feeding gas (13) and solid (powdery) substances (13*a*) into this chamber 16. Ducts 13, 13*a* are disposed in a level about one third of the vessel height down from the top. The vessel 11 has a top 17 in which is sealingly inserted a funnel member 14. Steel pours from ladle 7 through an opening 8 thereof into the funnel 14, to pour in free flow through chamber 16.

An annular gas tube 15 with upwardly directed exit nozzles and a slanted duct for feeding gas (e.g., nitrogen) thereto, is arranged around the funnel member 14. This way, a protective gas curtain is set up around the free falling stream of steel as it leaves the ladle 7.

The largest inner diameter of the conical portion of funnel member 14 is 20% larger than the diameter of the discharge opening 8 of the ladle 7. The vessel 11 has an upper surface, being the inner surface of top 17, and a larger, lower open face surface where seated on barriers 12. The area of that upper surface is larger than the square of four times the diameter of the ladle opening 8. The lower open surface is larger than the square of eight times that diameter of opening 8.

As a consequence, the pouring stream of steel as it passes through the chamber 16 will not per se create any significant pressure drop. The configuration of chamber 16 is that of a diffusor which aids additionally in the avoiding of such undesirable pressure reduction.

In accordance with the preferred mode of practicing the invention, nitrogen was fed to vessel 11 so that during the entire casting operation an excess pressure of 300 to 400 mm water was observed. This corresponds to a pressure of about 1.03 to 1.04 atmospheres.

A pressure controller 23 is provided to maintain this pressure level independently from the throughput of casting. The controller 23 may operate in response to a pressure sensing transducer 24. In order to test the effectiveness of such excess pressure, a gas analysis by a triple casting was made, which yielded the following results,

| mm water | $CO_2$ | $N_2$ | $O_2$ |
|---|---|---|---|
| −300 | 0.6 | 79.6 | 19.8 |
| −200 | 0.0 | 82.2 | 17.8 |
| −100 | 0.0 | 88.4 | 11.6 |
| 0 | 0.0 | 94.4 | 6.2 |
| +300 | 0.0 | 100.0 | 0.0 |

wherein the entries in the last three columns all denote percent of volume. The first column denotes the pressure difference to atmospheric pressure. Thus, at a pressure of −300 mm water below atmospheric pressure introduction of nitrogen had no noticeable effect. At some pressure, still below atmospheric pressure, the introduction of nitrogen did begin to show some effect. However, at an excess pressure of 300 mm water, the chamber 16 was and remains purged from oxygen and carbon dioxide.

The nitrogen is in parts carried along and temporarily mixed with the steel that pours down from the ladle into the tundish, while passing through vessel 11. Argon may be mixed with the nitrogen or fed separately into the chamber 16 to provide for additional cleansing action of the steel. As a consequence, the amount of hydrogen and of oxides carried further along by the steel, is significantly diminished.

Generally speaking, the nitrogen may be fed, for example, at a particular rate into chamber 16, but the rate may be insufficient to maintain the desired excess pressure. Therefore, additional gas is fed into chamber 16, possibly via the same duct 13, and the pressure control affects the feeding of that additional gaseous component to offset the loss of that cleansing gas.

The flow of cleansing agents into the vessel 11 may be controlled additionally to be proportional to the rate of flow of steel into the tundish. Thus, the control may operate in that the combined gas flow is pressure controlled, and the flow of all gases is increased and decreased as the pressure in chamber 16 requires, while the ratio of host gas, e.g., $N_2$ to additional active gas is changed at the rate of the steel flow.

The actions as described thus far have as primary function the prevention of reoxidation by operation of an excess pressure in chamber 16. This action may be supplemented with more positive deoxidation and/or desulfurization. Accordingly, metallic calcium and/or magnesium may be fed into the chamber 16 of vessel 11 via duct 13*a*. These materials actual vaporize at temperatures of liquid steel. Hence, they will evaporate in chamber 16 and will react particularly with any residual oxygen or with oxides such as $Al_2O_3$, and to convert them into CaO and MgO or mixed oxides thereof.

As stated, Ca and Mg evaporate in chamber 16. Therefore, the amount added to the chamber can be metered and controlled via pressure measurement in chamber 16. Accordingly, a source 26 for feeding these solids (via a worm screw or the like) into chamber 16 is provided. In lieu of the pressure control for nitrogen, a pressure sensing transducerr 25 may control the rate of feeding these solids into the chamber 16.

It should be noted that in cases it may well be sufficient to add only such evaporizing solids and to establish the necessary excess pressure in chamber 16 only on the basis of the resulting vapor.

In such a case, the source of controlled nitrogen 23 is not needed. Alternatively, the feeding rate of solids may be controlled to be proportionate to the rate of flow of molten steel through chamber 16. No such control is needed, if the entire atmosphere in chamber 16 is established on the basis of such reactant vapor. However, whenever, for example, nitrogen is used as the prime source for operational and dynamic purging and establishing of the excess pressure, then the nitrogen feeding may be pressure controlled via 24, 23, while the rate of feeding solids is controlled in correspondence to and in proportion to the rate of flow of the molten steel.

It can also be seen that the adding of powdery solids may have the primary function of evaporation for establishing the excess pressure environment and not all of the solids are provided for the additional, chemical reaction type cleaning of the steel. Consequently, additional cleansing gas may be added just for that purpose and merely contributing to the atmosphere. In this case, the adding of such gas or gases may be controlled to be in proportion to the rate of flow of the pouring steel.

Concerning the control aspects, another variant is the following. One controls the adding of treatment substances, that is gas or solids or both, in proportion to the rate of flow of steel or other metal to be sure that these substances are present at sufficient quantities. In addition, the pressure in chamber 16 is monitored and, if the pressure drops below a limit such as 300 mm water, additional substance is fed into the chamber to maintain a minimum pressure for preventing the influx of air.

Figure 2A:
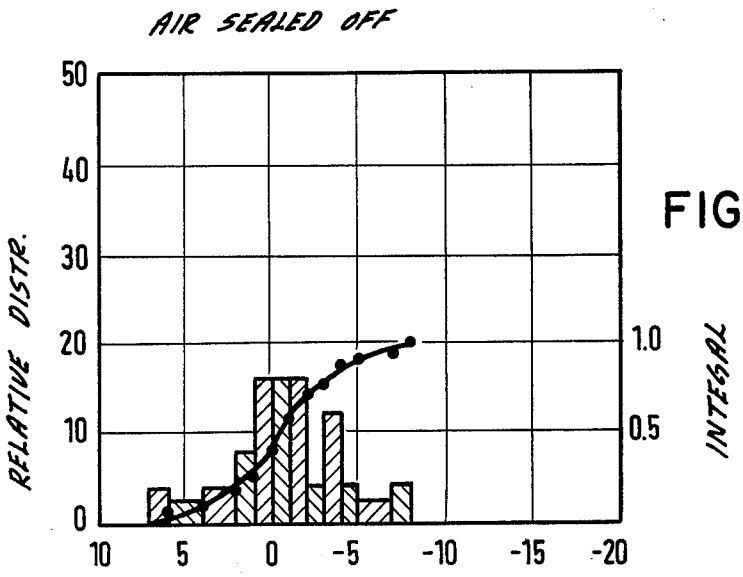
FIGS. 2*a* and 2*b* are two diagrams for comparing two methods.
Figure 2B:
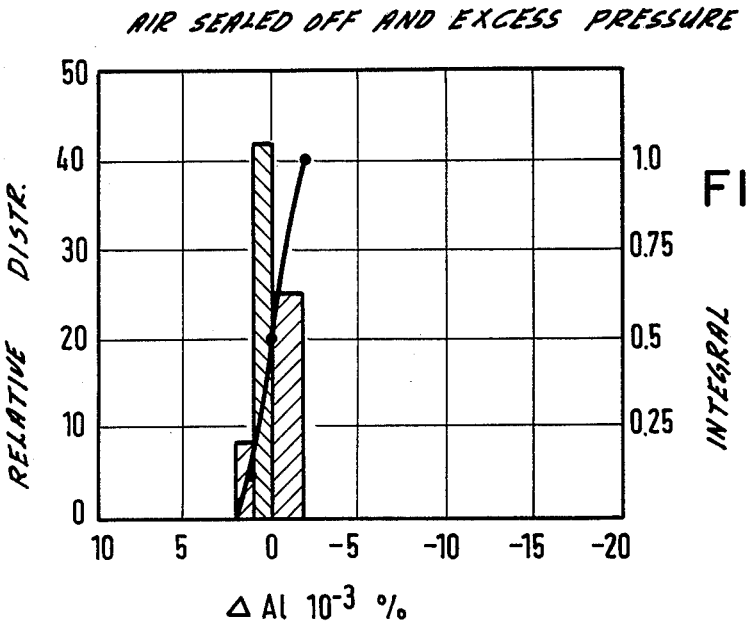

The FIGS. 2*a* and 2*b* represent a comparing statistical analysis of the difference in total aluminum content $\Delta Al$ as between such content of the steel as poured from the ladle, and the content in the tundish. FIG. 2*a* represents 50 different sample melts under closed conditions, but under exclusion of air, while FIG. 2*b* represents 50 different sample melts with an additional excess pressure of 300 to 400 mm water as outlined above.

The abscissa in both curves represents that $\Delta Al \cdot 10^3$ in percentage units as relative content in steel. The left-hand ordinate scale represents relative frequency and density distribution of the number of samples found to have an $\Delta Al$ content as per a given abscissa range. These numbers are plotted in hatched blocks. For example, in FIG. 2 about 41 samples showed a near $\Delta Al \cdot 10^3$ difference between 0 and 1. The right-hand scale has validity for the solid curves drawn through dots in both Figures; these curves represent the integral or sum of the respective density and distribution curve, reduced to a full scale value of 1 for the total of all samples.

It can readily be seen that the excess pressure provides for a significant, practically complete suppression of a reoxidation of the steel when treated in the outlined fashion under exclusion of air and under higher than atmospheric pressure.

In the example above, steel was given as the preferred metal to be treated as the invention arose pursuant to practicing continuous casting of steel. However, the invention is also applicable to other metals whose reoxidation is to be prevented following treatment in the ladle in preparation of the casting. Also, the reaction chamber 16 may be provided also or instead of the path between tundish and mold, if casting pipes, such as 3, are not used.

The invention is not limited to the embodiments described above but all changes and modifications thereof not constituting departures from the spirit and scope of the invention are intended to be included.

We claim:

1. Method of treating and preventing reoxidation of molten metals in a process for continuous casting and while pouring from a first vessel into a second vessel, the metal leaving the second vessel continuously for continuous casting, wherein a third vessel surrounds the metal as poured from the first vessel, the third vessel defining a reaction chamber being larger than the stream of pouring metal and being closed but for inlets for the poured metal and additives, the steps of measuring the pressure in said third vessel; and feeding at least one treatment substance into the third vessel at such a rate that the gaseous state of the substance establishes an excess pressure in the third vessel, said feeding maintains an excess pressure in the chamber of sufficient quantity to prevent the influx of ambient air into that vessel and replenishes the substance as it is being drawn into the molten metal as leaving the second vessel.

2. Method as in claim 1, using at least one substance in the gaseous phase which provides for chemical reaction with particular components being included in the molten metal.

3. Method as in claim 2, wherein the substance is added to the chamber in the non-gaseous phase and evaporates in the chamber.

4. Method as in claim 3, wherein the substance is at least one solid fed into the third vessel.

5. Method as in claim 4, wherein the excesspressure is exclusively established through evaporation of the solid or solids.

6. Method as in claim 2, and including the step of adding said substance at a particular rate to maintain a constant pressure in the chamber.

7. Method as in claim 2, and including the step of varying the substance in proporiton to the metal passing through the chamber while maintaining an excess pressure at a particular level.

8. Method of treating molten steel during a continuous casting process as it pours into a tundish or a mold from which the steel flows off continuously, comprising the steps of:

surrounding the stream of poured steel at least in parts with a vessel being closed but for a steel inlet and for at least one inlet for additives and having no outlet;

feeding a solid material as additive through the one or more inlets for at least one of the following, deoxidation and desulfurization, such as at least one of the following, calcium and magnesium, into the vessel for evaporation therein;

measuring the pressure in the vessel; and controlling the rate of feeding in dependence upon the measuring of the pressure so that a pressure in excess of atmospheric pressure is maintained in the vessel to prevent influx of ambient air, and to replenish the material as it is being drawn into the outflow of metal from the tundish or mold.

9. Method as in claim 8, wherein nitrogen is additionally fed into the vessel.

10. In a machine for continuous casting wherein molten metal is poured from a first vessel into a second vessel from which the metal leaves continuously due to the continuous casting, the improvement comprising:

a third vessel disposed between the first vessel and the second vessel and defining a confined chamber through which passes a stream of the metal as poured, the third vessel being open at the bottom, but the bottom being effectively closed by the molten metal in the second vessel, the third vessel having an inlet for steel and at least one inlet for additives, but no outlet;

means for measuring the pressure in the third vessel;

means connected to the one or more inlets for additives for feeding one or more substances into the third vessel which will not oxidize the metal, the substance or substances being and/or assuming the gaseous state in the third vessel; and means connected to the means for measuring and to the means for feeding, for controlling the feeding so as to maintain an excess pressure in the third vessel of the substance in the gaseous state for preventing the influx of air into the third vessel, and for replenishing the outflow of substance by being entrained in the metal as leaving the second vessel.

11. In a casting machine as in claim 10, wherein the first vessel has opening for pouring of the metal and having a particular diameter, the third vessel having an upper wall through which enters the metal as poured and a lower opening facing the metal in the second vessel, the upper wall having a surface area larger than the square of the four-fold value of said diameter, said opening covering an area larger than the square of the eight-fold value of said diameter.

12. In a casting machine as in claim 10, wherein a funnel is provided on the third vessel, having a diameter about 20% larger than an opening in the first vessel from which the metal pours from the first vessel into and through the funnel and into the second vessel.

13. In a casting machine as in claim 10, said third vessel having at least one inlet pipes for the gas or gas forming substances, in the upper portion of the third vessel.

* * * * *